US011344129B2

(12) United States Patent
Walker

(10) Patent No.: US 11,344,129 B2
(45) Date of Patent: May 31, 2022

(54) PORTABLE SEAT ASSEMBLY

(71) Applicant: Lawrence Walker, Republic, MI (US)

(72) Inventor: Lawrence Walker, Republic, MI (US)

( * ) Notice: Subject to any disclaimer, the term of this patent is extended or adjusted under 35 U.S.C. 154(b) by 212 days.

(21) Appl. No.: 16/750,888

(22) Filed: Jan. 23, 2020

(65) Prior Publication Data

US 2021/0227983 A1 Jul. 29, 2021

(51) Int. Cl.

| | |
|---|---|
| ***A45F 4/00*** | (2006.01) |
| ***A47C 9/10*** | (2006.01) |
| ***A47C 7/62*** | (2006.01) |
| ***A45F 3/44*** | (2006.01) |
| ***A47C 7/00*** | (2006.01) |
| ***A45F 3/14*** | (2006.01) |

(52) U.S. Cl.

CPC ..... *A47C 9/10* (2013.01); *A45F 3/14* (2013.01); *A45F 3/44* (2013.01); *A47C 7/004* (2013.01); *A47C 7/628* (2018.08); *A45F 2003/142* (2013.01)

(58) Field of Classification Search

CPC ..... A47C 9/10; A45F 2004/026
USPC ..... 297/4
See application file for complete search history.

(56) References Cited

U.S. PATENT DOCUMENTS 1,220,316 A * 3/1917 Bragg ..... A47C 9/04 297/4
1,379,129 A * 5/1921 Sejnoha ..... A47C 9/10 108/166
1,956,956 A * 5/1934 Leibo ..... A47C 9/10 297/378.1
2,064,215 A * 12/1936 Noe ..... A47C 9/10 248/155
2,690,211 A * 9/1954 Wentz ..... A45B 5/00 248/155.1
2,720,249 A * 10/1955 Peterson ..... A47C 9/10 108/141
2,800,164 A * 7/1957 Chambers ..... A45B 5/00 248/155.1
2,877,828 A * 3/1959 Barnette, Jr. ..... A47C 9/10 248/533
3,058,711 A * 10/1962 Kingsford ..... A47C 9/10 248/155.2
3,165,077 A * 1/1965 Olson ..... A47C 9/10 108/33
3,177,825 A * 4/1965 Jones ..... A45B 5/00 108/128
3,283,733 A * 11/1966 Boerma ..... A45F 3/44 108/159
3,467,033 A * 9/1969 Remer ..... A47C 9/10 108/150
4,098,478 A * 7/1978 Spitzke ..... A47C 9/10 297/4 X (Continued)

*Primary Examiner* — Rodney B White

(57) ABSTRACT

A portable seat assembly for facilitating a user to be seated in any location includes a pole that is insertable into ground having the pole being vertically oriented. A stop is positionable around the pole to inhibit over insertion of the pole into the ground. A seat is removably attachable to the pole to facilitate a user to sit thereon. Additionally, the seat has a storage chamber integrated therein for storing objects. A lid is removably attachable to the seat and a cushion is coupled to the lid for the user to sit upon. A strap is removably attachable to the seat for wearing over the user's shoulders to carry the seat.

11 Claims, 7 Drawing Sheets

(56) References Cited

U.S. PATENT DOCUMENTS

| | | | | | |
|---|---|---|---|---|---|
| 4,101,163 | A * | 7/1978 | Morin | A47C 9/10 | 297/4 X |
| 4,232,896 | A | 11/1980 | Caldwell | | |
| 4,318,567 | A * | 3/1982 | Guthier | A47C 15/004 | 297/188.2 X |
| 4,451,080 | A * | 5/1984 | Nix | A61H 3/00 | 297/4 X |
| 4,641,882 | A | 2/1987 | Young | | |
| 4,848,712 | A * | 7/1989 | Russell | A47C 9/10 | 248/155.2 |
| 5,673,966 | A * | 10/1997 | Morton, Jr. | A47C 9/10 | 297/4 X |
| 5,954,248 | A * | 9/1999 | Jasper | A47C 4/52 | 297/4 X |
| 6,062,638 | A | 5/2000 | Ferguson | | |
| 6,176,545 | B1 * | 1/2001 | Hambleton | A47C 9/10 | 297/4 X |
| 6,467,843 | B1 * | 10/2002 | Rossborough | A47C 3/34 | 297/344.18 X |
| 6,893,097 | B1 * | 5/2005 | Ebensperger | A47C 9/10 | 297/4 X |
| 7,740,308 | B2 | 6/2010 | Mishly | | |
| 8,591,383 | B1 * | 11/2013 | McAlpin | A47L 23/16 | 482/34 |
| 9,079,056 | B1 * | 7/2015 | McAlpin | A63B 23/0458 | |
| 9,803,798 | B1 * | 10/2017 | Rockhill | A47C 3/20 | |
| 2010/0314919 | A1 | 12/2010 | Jackson | | |
| 2015/0054328 | A1 * | 2/2015 | Barstad | A47C 4/03 | 297/440.24 |
| 2016/0192780 | A1 * | 7/2016 | Sinclair | A47C 4/04 | 297/183.5 |
| 2018/0014653 | A1 * | 1/2018 | Reynolds | A47C 9/10 | |
| 2020/0046124 | A1 * | 2/2020 | Park | A47C 7/02 | |
| 2020/0178694 | A1 * | 6/2020 | Bland | A01K 97/10 | |

* cited by examiner

PORTABLE SEAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to seat devices and more particularly pertains to a new seat device for facilitating a user to be seated in any location.

(2) Description of Related Art Including Information Disclosed Under 37 CFR 1.97 and 1.98

The prior art relates to seat devices. The prior art discloses a collapsible seat that includes a pole being pivotally coupled to a seat which can be suspended from a waist belt of a user. The prior art discloses an orthopedic appliance that includes a seat. The prior art discloses a seat that includes a membrane being stretched over a support pole. Additionally, the prior art discloses a portable seat that includes a telescopic pole and support legs that angle outwardly from the telescopic pole. Generally speaking, the prior art discloses seats that include movable couplings rather than modular construction for disassembly.

BRIEF SUMMARY OF THE INVENTION

An embodiment of the disclosure meets the needs presented above by generally comprising a pole that is insertable into ground having the pole being vertically oriented. A stop is positionable around the pole to inhibit over insertion of the pole into the ground. A seat is removably attachable to the pole to facilitate a user to sit thereon. Additionally, the seat has a storage chamber integrated therein for storing objects. A lid is removably attachable to the seat and a cushion is coupled to the lid for the user to sit upon. A strap is removably attachable to the seat for wearing over the user's shoulders to carry the seat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
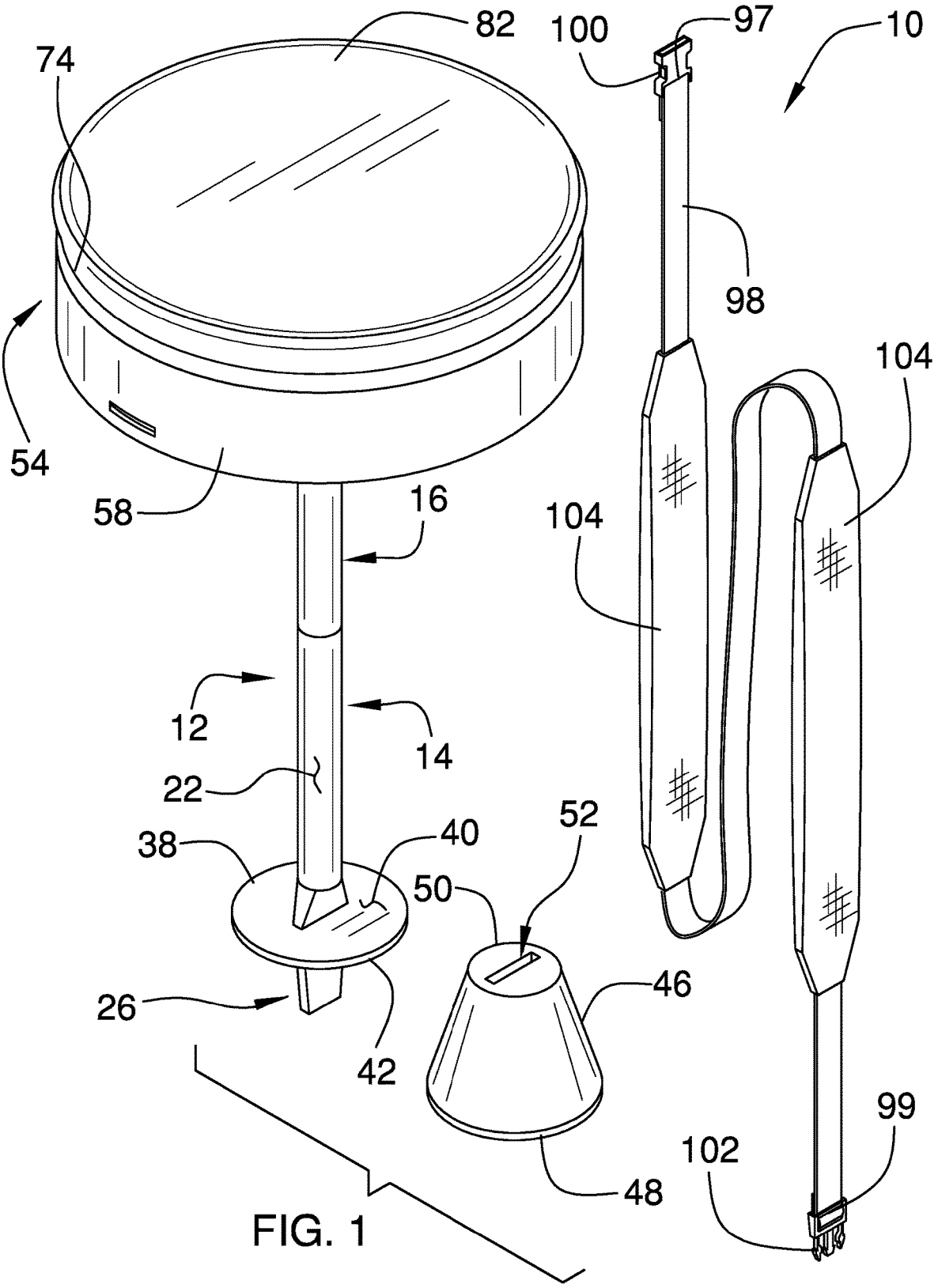
FIG. 1 is a perspective view of a portable seat assembly according to an embodiment of the disclosure.
Figure 2:
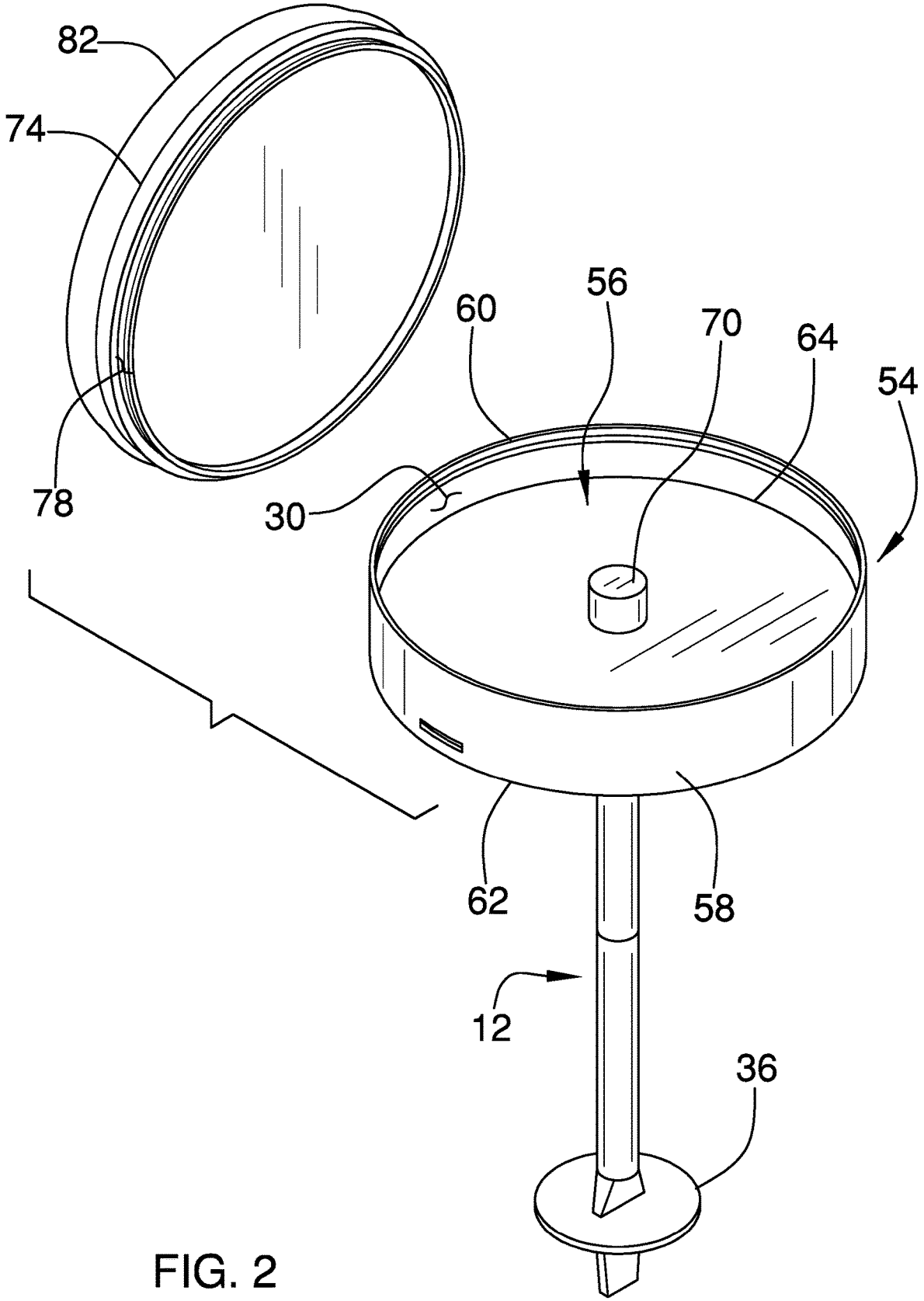
FIG. 2 is an exploded perspective view of an embodiment of the disclosure showing a lid being removed from a seat.
Figure 3:
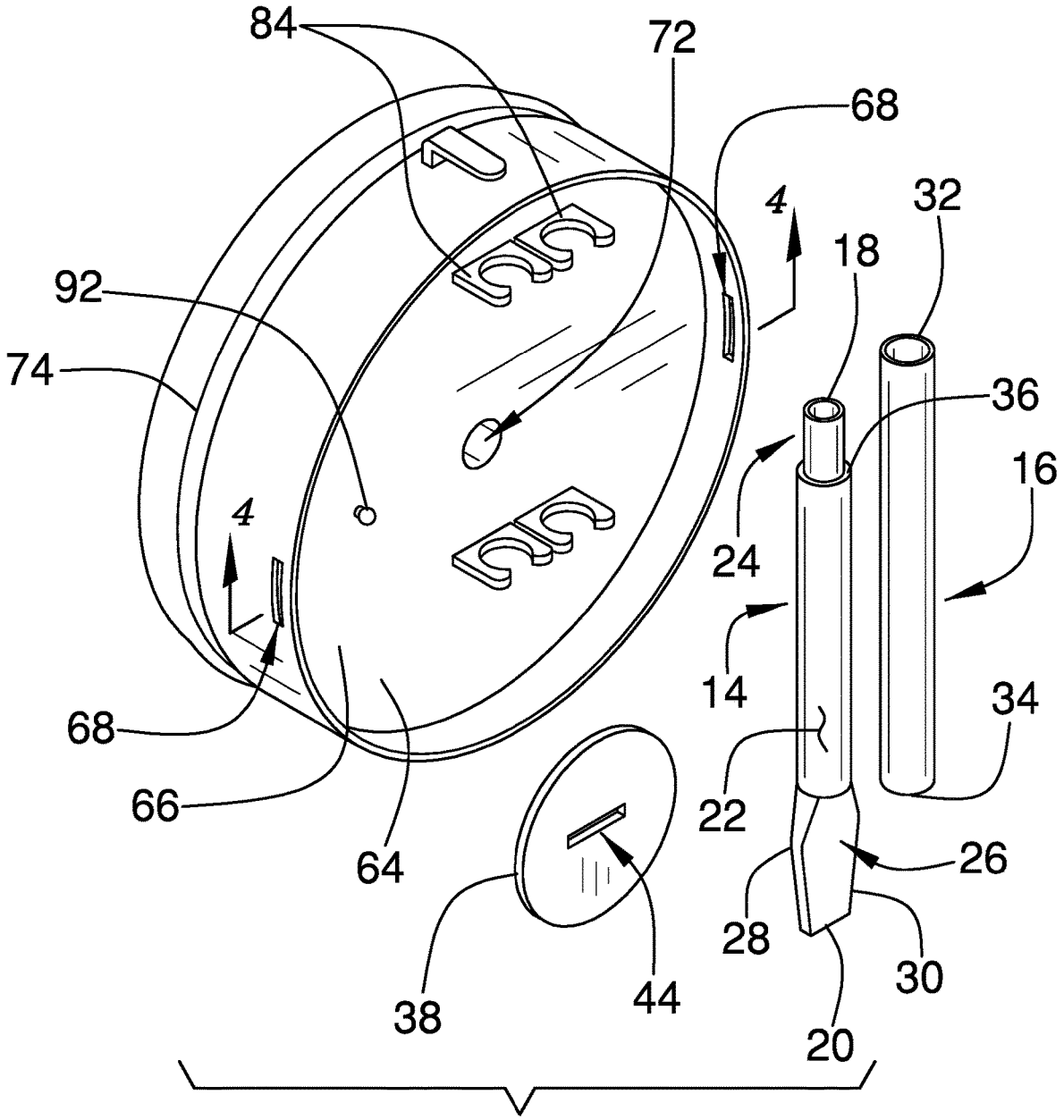
FIG. 3 is a bottom perspective view of an embodiment of the disclosure.
Figure 4:
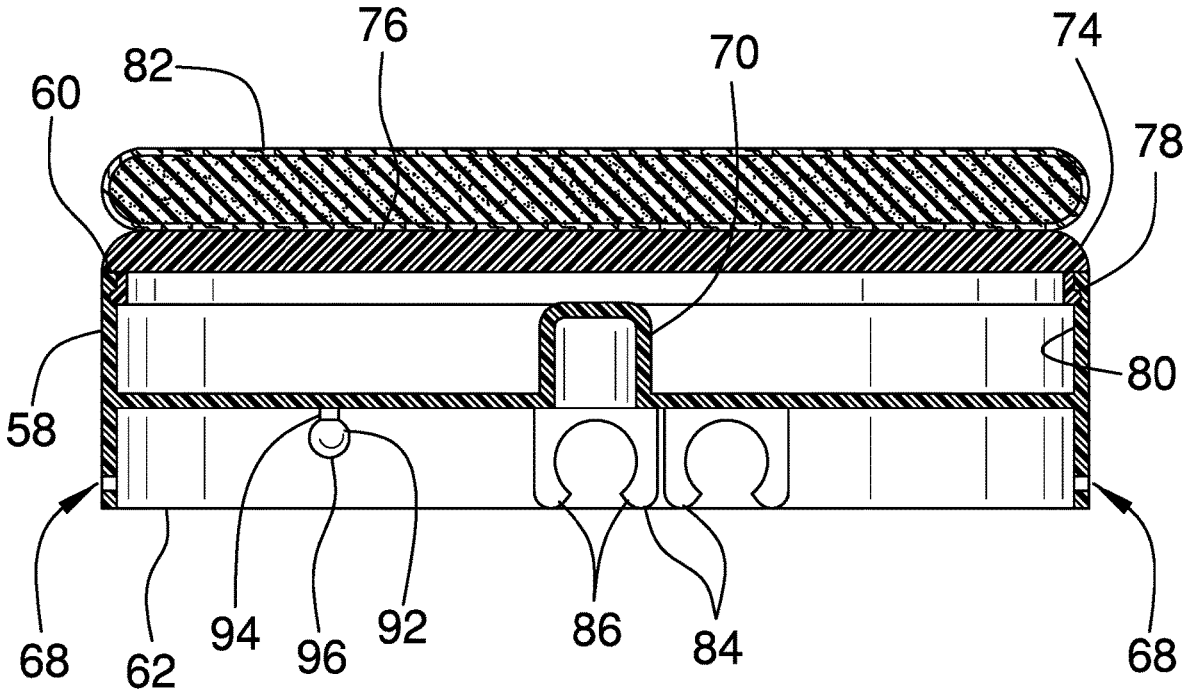
FIG. 4 is a cross sectional view taken along line 4-4 of FIG. 3 of an embodiment of the disclosure.
Figure 6:
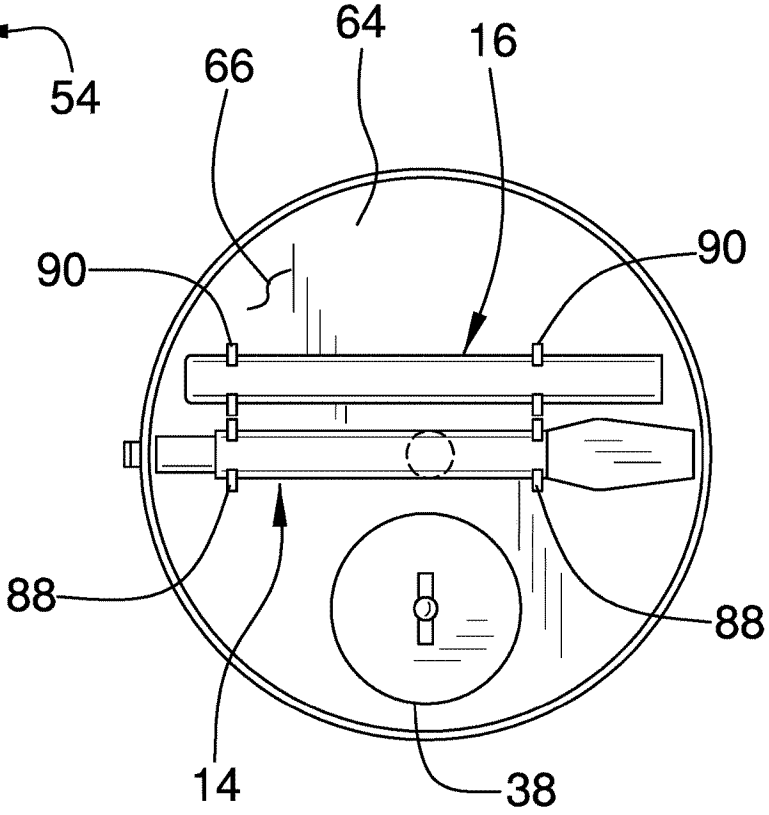
FIG. 6 is a bottom view of an embodiment of the disclosure.
Figure 5:
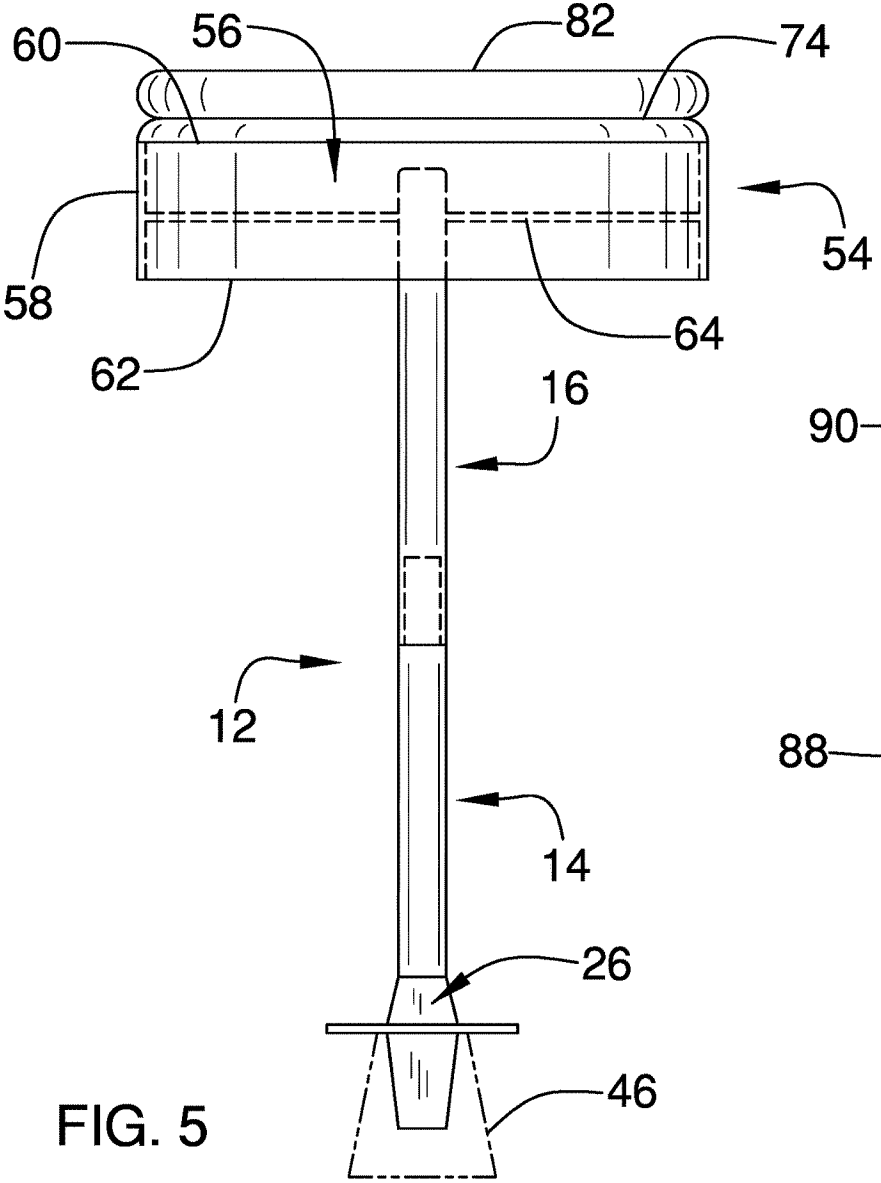
FIG. 5 is a front phantom view of an embodiment of the disclosure.
Figure 7:
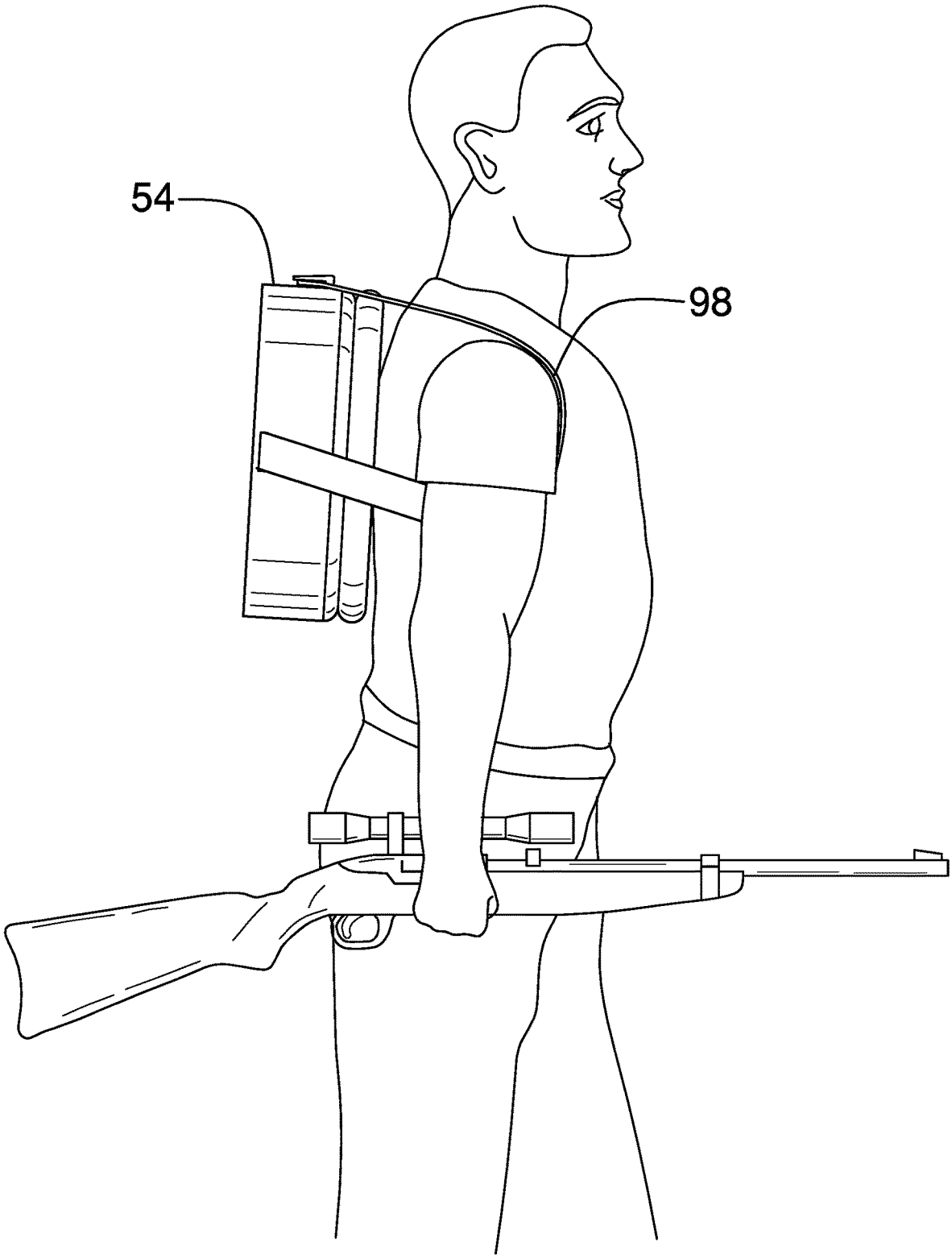
FIG. 7 is a perspective in-use view of an embodiment of the disclosure.
Figure 8:
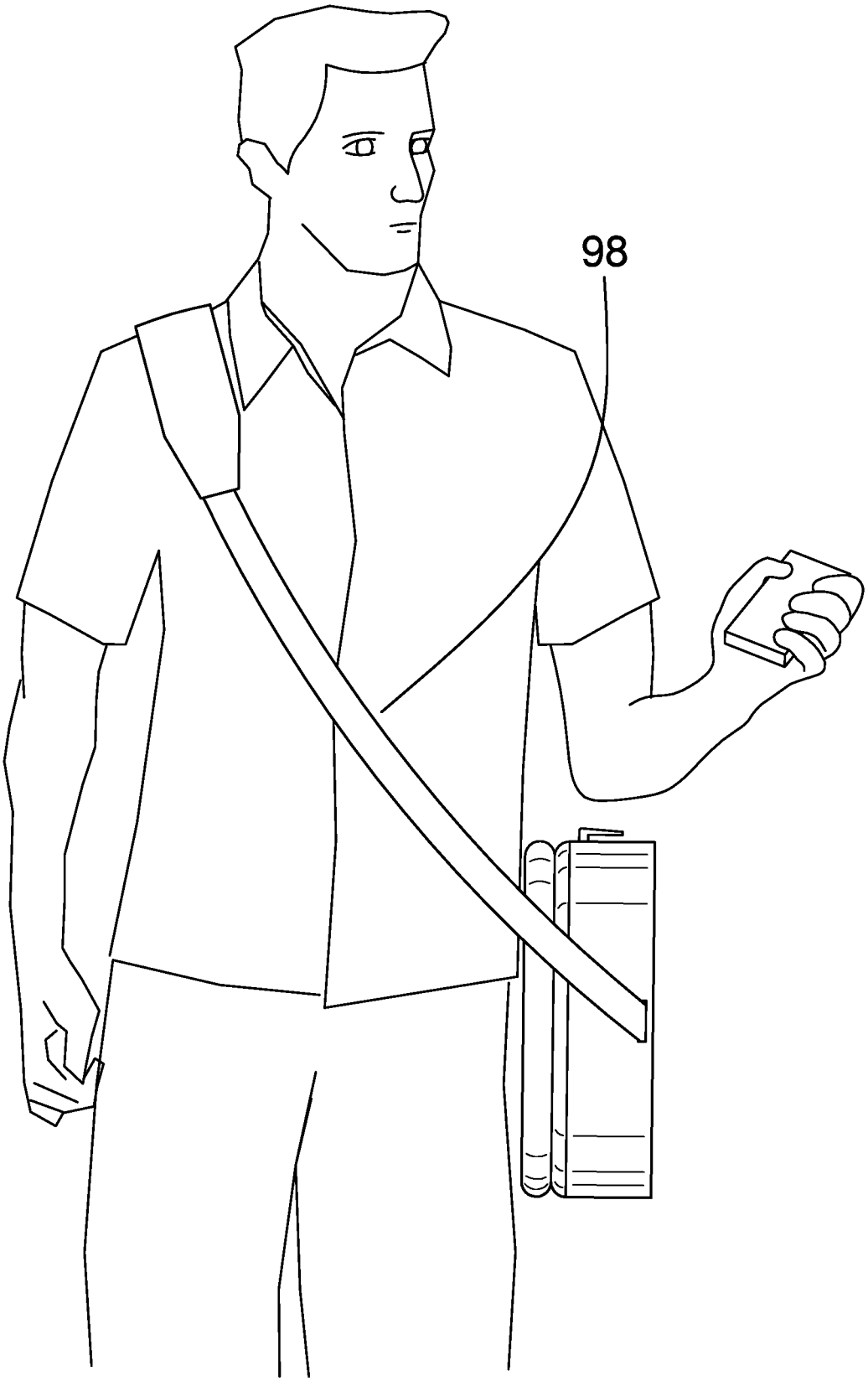
FIG. 8 is a front perspective in-use view of an embodiment of the disclosure.

With reference now to the drawings, and in particular to FIGS. 1 through 8 thereof, a new seat device embodying the principles and concepts of an embodiment of the disclosure and generally designated by the reference numeral 10 will be described.

As best illustrated in FIGS. 1 through 8, the portable seat assembly 10 generally comprises a pole 12 which includes a first half 14 that insertably engages a second half 16. The pole 12 is insertable into ground having the pole 12 being vertically oriented. Additionally, the pole 12 may have a length ranging between approximately 15.0 inches and 20.0 inches.

The first half 14 has a first end 18, a second end 20 and an outer surface 22 extending therebetween, and the outer surface 22 has an inset portion 24 extending from the first end 18 toward the second end 20. Additionally, the outer surface 22 has a flattened portion 26 extending from the second end 20 toward the first end 18 for penetrating ground. The flattened portion 26 has a first lateral edge 28 and a second lateral edge 30, and each of the first lateral edge 28 and the second lateral edge 30 angles outwardly proximate a center point of the flattened portion 26.

The second half 16 has a primary end 32 and a secondary end 34, and each of the primary end 32 and the secondary end 34 is open. The secondary end 34 insertably receives the inset portion 24 of the outer surface 22 of the first half 14 having the secondary end 34 abutting a bounding edge 36 of the inset portion 24. A stop 38 is positionable around the pole 12 to inhibit over insertion of the pole 12 into the ground. The stop 38 has a top surface 40 and a bottom surface 42, and the stop 38 has a slot 44 extending through the top surface 40 and the bottom surface 42. The slot 44 insertably receives the flattened portion 26 of the outer surface 22 of the second half 16 of the pole 12. Moreover, the stop 38 has a length that is less that the maximum width of the flattened portion 26 thereby inhibiting the flattened portion 26 from passing through the slot 44.

A base 46 is provided and the base 46 is attachable to the pole 12 to support the pole 12 on an impenetrable support surface. The base 46 has a bottom end 48 and a top end 50, and the bottom end 48 has a diameter that is greater than the diameter of the top end 50. The top end 50 has a well 52 extending downwardly toward the bottom end 48 and the well 52 has a length is greater than its width such that the well 52 has a rectangular shape. The well 52 insertably receives the flattened portion 26 of the outer surface 22 of the second half 16 of the pole 12. As is most clearly shown in FIG. 5, the top end 50 of the base 46 abuts the bottom surface 42 of the stop 38 to inhibit the base 46 from sliding upwardly on the pole 12.

A seat 54 is provided and the seat 54 is removably attachable to the pole 12 to facilitate a user to sit thereon. The seat 54 has a storage chamber 56 integrated therein for storing objects. The seat 54 has an outer wall 58 that is continuously arcuate about a center point of the seat 54 such that the outer wall 58 defines a closed loop. The outer wall 58 has an upper edge 60 and a lower edge 62. The seat 54 has a dividing wall 64 that is attached to the outer wall 58. The dividing wall 64 is centrally positioned between the upper edge 60 and the lower edge 62 to define the storage chamber 56 extending between the dividing wall 64 and the upper edge 60. The dividing wall 64 has a bottom surface 66 that is directed toward the lower edge 62 of the outer wall 58.

The outer wall 58 has a pair of strap openings 68 each extending through the outer wall 58. Each of the strap openings 68 is positioned on opposite sides of the outer wall 58 with respect to each other. Moreover, each of the strap openings 68 is positioned between the lower edge 62 of the outer wall 58 and the dividing wall 64. The dividing wall 64 has a cup 70 integrated therein and the cup 70 has an opening 72 that is disposed on the bottom surface 42 of the dividing wall 64. The cup 70 is centrally positioned on the dividing wall 64 and the cup 70 insertably receives the primary end 32 of the second half 16 of the pole 12.

A lid 74 is removably attachable to the seat 54 and the lid 74 has a top side 76 and a perimeter surface 78. The perimeter surface 78 is continuously arcuate about a center point of the lid 74 such that the lid 74 has a disk shape and the perimeter surface 78 is threaded. Moreover, the perimeter surface 78 threadably engages an inwardly facing surface 80 of the outer wall 58 of the seat 54 having the lid 74 resting against the upper edge 60 of the seat 54. A cushion 82 is coupled to the lid 74 and the user can sit on the lid 74. The cushion 82 is comprised of a resiliently compressible material to enhance comfort for the user and the cushion 82 is positioned on the top side 76 of the lid 74.

A plurality of engagements 84 is each coupled to the seat 54 and each of the engagements 84 releasably engages a respective one of the first half 14 or the second half 16 of the pole 12 for storage. Each of the engagements 84 is positioned on the bottom surface 42 of the dividing wall 64. Additionally, each of the engagements 84 includes a pair of fingers 86 that are spaced apart from each other for having the respective first half 14 of second half 16 being positioned therebetween. In this way the first half 14 and the second half 16 are retained in the engagements 84 for storage. Moreover, the engagements 84 are arranged to define a set of first engagements 88 that are aligned with each other and a set of second engagements 90 that are aligned with each other. Each of the first half 14 and the second half 16 are positionable in respective first engagements 88 or second engagements 90.

A coupler 92 is coupled to the seat 54 and the coupler 92 releasably engages the stop 38 for storing the stop 38. The coupler 92 includes a stem 94 and a head 96, and the stem 94 extends away from the bottom surface 42 of the dividing wall 64. The head 96 is extendable through the slot 44 in the stop 38 for retaining the stop 38 on the coupler 92.

A strap 98 is removably attachable to the seat 54 for wearing over the user's shoulders to carry the seat 54. The strap 98 has a first end 97 and a second end 99, and the first end 98 of the strap 98 is matable to the second end 99 of the strap 98. The strap 98 is extendable through each of the strap openings 68 in the outer wall 58 of the seat 54. The strap 98 may include a first mating member 100 attached to the first end 98 of the strap 98 and a second mating member 102 attached to the second end 99 of the strap 98. The first mating member 100 may releasably engage the second mating member 102. Additionally, the strap 98 may include a plurality of pads 104 being positioned thereon for enhancing comfort for the user.

In use, the first half 14 of the pole 12 is attached to the second half 16 of the pole 12 and the stop 38 is positioned on the flattened portion 26 of the second half 16. The flattened portion 26 is urged to penetrate ground until the stop 38 rests on the ground. The seat 54 is attached to the pole 12 thereby facilitating the user to be seated in a situation that would otherwise require the user to keel on the ground or sit on the ground. The base 46 positioned on the pole 12 when the pole 12 is positioned on an impenetrable support surface, such as a concrete floor or the like. The first half 14 and the second half 16 are attachable to respective engagements 84 for storage and the stop 38 is attachable to the coupler 92 for storage. The base 46, along with other objects, can be stored in the storage chamber 56. The strap 98 is extendable through the strap openings 68 and the strap 98 is worn over the user's shoulders for carrying the seat 54 and all of the attendant components.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable seat assembly being configured to facilitate a user to sit on a seat in any location, said assembly comprising:

a pole comprising a first half that insertably engages a second half, said pole being insertable into ground having said pole being vertically oriented;

a stop being positionable around said pole wherein said stop is configured to inhibit over insertion of said pole into the ground;

a base being attachable to said pole wherein said base is configured to support said pole on an impenetrable support surface;

a seat being removably attachable to said pole wherein said seat is configured to facilitate a user to sit thereon, said seat having a storage chamber being integrated therein fir storing objects;

a lid being removably attachable to said seat;

a cushion being coupled to said lid wherein said cushion is configured to have the user sit thereon, said cushion being comprised of a resiliently compressible material wherein said cushion is configured to enhance comfort for the user;

a strap being removably attachable to said seat wherein said strap is configured to be worn over the user's shoulders for carrying said seat;

wherein said first half has a first end, a second end and an outer surface extending therebetween, said outer surface having an inset portion extending from said first end toward said second end, said outer surface having a flattened portion extending from said second end toward said first end wherein said flattened portion is configured to penetrate ground;

wherein said flattened portion has a first lateral edge and a second lateral edge, each of said first lateral edge and said second lateral edge angling outwardly proximate a center point of said flattened portion; and wherein said stop has a top surface and a bottom surface, said stop having a slot extending through said top surface and said bottom surface, said slot insertable receiving said flattened portion of said outer surface of said second half of said pole, said slot having a length being less than the maximum width of said flattened portion thereby inhibiting said flattened portion from passing through said slot.

2. The assembly according to claim 1, wherein said second half has a primary end and a secondary end, each of said primary end and said secondary end being open, said secondary end insertably receiving said inset portion of said outer surface of said first half having said secondary end abutting a bounding edge of said inset portion.

3. The assembly according to claim 1, wherein said base has a bottom end and a top end, said bottom end having a diameter being greater than the diameter of said top end, said top end having a well extending downwardly toward said bottom end, said well having a length being greater than a width of said well such that said well has a rectangular shape, said well insertably receiving said flattened portion of said outer surface of said second half of said pole.

4. A portable seat assembly being configured to facilitate a user to sit on a seat in any location, said assembly comprising:

a pole comprising a first half that insertably engages a second half, said pole being insertable into ground having said pole being vertically oriented;

a stop being positionable around said pole wherein said stop is configured to inhibit over insertion of said pole into the ground;

a base being attachable to said pole wherein said base is configured to support said pole on an impenetrable support surface;

a seat being removably attachable to said pole wherein said seat is configured to facilitate a user to sit thereon, said seat having a storage chamber being integrated therein for storing objects;

a lid being removably attachable to said seat;

a cushion being coupled to said lid wherein said cushion is configured to have the user sit thereon, said cushion being comprised of a resiliently compressible material wherein said cushion is configured to enhance comfort for the user;

a strap being removably attachable to said seat wherein said strap is configured to be worn over the user's shoulders for carrying said seat;

wherein said first half has a first end, a second end and an outer surface extending therebetween, said outer surface having an inset portion extending from said first end toward said second end, said outer surface having a flattened portion extending from said second end toward said first end wherein said flattened portion is configured to penetrate ground;

wherein said flattened portion has a first lateral edge and a second lateral edge, each of said first lateral edge and said second lateral edge angling outwardly proximate a center point of said flattened portion;

wherein said second half has a primary end and a secondary end, each of said primary end and said secondary end being open, said secondary end insertably receiving said inset portion of said outer surface of said first half having said secondary end abutting a bounding edge of said inset portion; and wherein said seat has an outer wall being continuously arcuate about a center point of said seat such that said outer wall defines a closed loop, said outer wall having an upper edge and a lower edge, said seat having a dividing wall being attached to said outer wall, said dividing wall being centrally positioned between said upper edge and said lower edge to define said storage chamber extending between said dividing wall and said upper edge, said dividing wall having a bottom surface being directed toward said lower edge of said outer wall.

5. The assembly according to claim 4, wherein said outer wall has a pair of strap openings each extending through said outer wall, each of said strap openings being positioned on opposite sides of said outer wall with respect to each other, each of said strap openings being positioned between said lower edge of said outer wall and said dividing wall.

6. The assembly according to claim 4, wherein said dividing wall has a cup being integrated therein, said cup having an opening being disposed on said bottom surface of said dividing wall, said cup being centrally positioned on said dividing wall, said cup insertably receiving said primary end of said second half of said pole.

7. The assembly according to claim 4, wherein said lid has a top side and a perimeter surface, said perimeter surface being continuously arcuate about a center point of said lid such that said lid has a disk shape, said perimeter surface being threaded, said perimeter surface threadably engaging an inwardly facing surface of said outer wall of said seat having said lid resting against said upper edge of said seat.

8. The assembly according to claim 4, further comprising a plurality of engagements, each of said engagements being coupled to said seat, each of said engagements releasably engaging a respective one of said first half or said second half of said pole for storage, each of said engagements being positioned on said bottom surface of said dividing wall, each of said engagements including a pair of fingers being spaced apart from each other for having said respective first half of second half being positioned therebetween for retaining said first half and said second half in said engagements.

9. The assembly according to claim 8, wherein said engagements are arranged to define a set of first engagements being aligned with each other and a set of second engagements being aligned with each other.

10. The assembly according to claim 4, further comprising a coupler being coupled to said seat, said coupler releasably engaging said stop for storing said stop, said coupler including a stem and a head, said stem extending away from said bottom surface of said dividing wall, said head being extendable through said slot in said stop for retaining said stop on said coupler.

11. A portable seat assembly being configured to facilitate a user to sit on a seat in any location, said assembly comprising:

a pole comprising a first half that insertably engages a second half, said pole being insertable into ground having said pole being vertically oriented, said first half having a first end, a second end and an outer surface extending therebetween, said outer surface having an inset portion extending from said first end toward said second end, said outer surface having a flattened portion extending from said second end toward said first end wherein said flattened portion is configured to penetrate ground, said flattened portion having a first lateral edge and a second lateral edge, each of said first lateral edge and said second lateral edge angling outwardly proximate a center point of said flattened portion, said second half having a primary end and a secondary end, each of said primary end and said secondary end being open, said secondary end insertably receiving said inset portion of said outer surface of said first half having said secondary end abutting a bounding edge of said inset portion;

a stop being positionable around said pole wherein said stop is configured to inhibit over insertion of said pole into the ground, said stop having a top surface and a bottom surface, said stop having a slot extending through said top surface and said bottom surface, said slot insertably receiving said flattened portion of said outer surface of said second half of said pole, said slot having a length being less than the maximum width of said flattened portion thereby inhibiting said flattened portion from passing through said slot;

a base being attachable to said pole wherein said base is configured to support said pole on an impenetrable support surface, said base having a bottom end and a top end, said bottom end having a diameter being greater than the diameter of said top end, said top end having a well extending downwardly toward said bottom end, said well having a length being greater than a width of said well such that said well has a rectangular shape, said well insertably receiving said flattened portion of said outer surface of said second half of said pole;

a seat being removably attachable to said pole wherein said seat is configured to facilitate a user to sit thereon, said seat having a storage chamber being integrated therein for storing objects, said seat having an outer wall being continuously arcuate about a center point of said seat such that said outer wall defines a closed loop, said outer wall having an upper edge and a lower edge, said seat having a dividing wall being attached to said outer wall, said dividing wall being centrally positioned between said upper edge and said lower edge to define said storage chamber extending between said dividing wall and said upper edge, said dividing wall having a bottom surface being directed toward said lower edge of said outer wall, said outer wall having a pair of strap openings each extending through said outer wall, each of said strap openings being positioned on opposite sides of said outer wall with respect to each other, each of said strap openings being positioned between said lower edge of said outer wall and said dividing wall, said dividing wall having a cup being integrated therein, said cup having an opening being disposed on said bottom surface of said dividing wall, said cup being centrally positioned on said dividing wall, said cup insertably receiving said primary end of said second half of said pole;

a lid being removably attachable to said seat, said lid having a top side and a perimeter surface, said perimeter surface being continuously arcuate about a center point of said lid such that said lid has a disk shape, said perimeter surface being threaded, said perimeter surface threadably engaging an inwardly facing surface of said outer wall of said seat having said lid resting against said upper edge of said seat;

a cushion being coupled to said lid wherein said cushion is configured to have the user sit thereon, said cushion being comprised of a resiliently compressible material wherein said cushion is configured to enhance comfort for the user, said cushion being positioned on said top side of said lid;

a plurality of engagements, each of said engagements being coupled to said seat, each of said engagements releasably engaging a respective one of said first half or said second half of said pole for storage, each of said engagements being positioned on said bottom surface of said dividing wall, each of said engagements including a pair of fingers being spaced apart from each other for having said respective first half of second half being positioned therebetween for retaining said first half and said second half in said engagements, said engagements being arranged to define a set of first engagements being aligned with each other and a set of second engagements being aligned with each other;

a coupler being coupled to said seat, said coupler releasably engaging said stop for storing said stop, said coupler including a stem and a head, said stem extending away from said bottom surface of said dividing wall, said head being extendable through said slot in said stop for retaining said stop on said coupler; and a strap being removably attachable to said seat wherein said strap is configured to be worn over the user's shoulders for carrying said seat, said strap having a first end and a second end, said first end of said strap being matable to said second end of said strap, said strap being extendable through each of said strap slots in said outer wall of said seat.

* * * * *